US009620907B1

(12) United States Patent
Henry et al.

(10) Patent No.: US 9,620,907 B1
(45) Date of Patent: Apr. 11, 2017

(54) RECEPTACLE ASSEMBLY HAVING A GASKET ASSEMBLY FOR EMI SHIELDING

(71) Applicant: TYCO ELECTRONICS CORPORATION, Berwyn, PA (US)

(72) Inventors: Randall Robert Henry, Harrisburg, PA (US); Michael John Phillips, Camp Hill, PA (US); Richard James Long, Columbia, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/186,954

(22) Filed: Jun. 20, 2016

(51) Int. Cl.
*H01R 13/66* (2006.01)
*H01R 13/6582* (2011.01)
*H01R 12/72* (2011.01)

(52) U.S. Cl.
CPC ..... *H01R 13/6582* (2013.01); *H01R 12/721* (2013.01); *H01R 13/665* (2013.01)

(58) Field of Classification Search
CPC ..... H01R 13/6594
USPC ..... 439/607.21, 607.2
See application file for complete search history.

(56) References Cited

U.S. PATENT DOCUMENTS

| | | | | |
|---|---|---|---|---|
| 7,044,763 | B1 * | 5/2006 | Inoue | H05K 3/301 439/326 |
| 7,070,446 | B2 * | 7/2006 | Henry | H01R 13/65802 439/541.5 |
| 7,204,710 | B1 * | 4/2007 | Sato | G02B 6/3897 439/326 |
| 8,426,751 | B2 * | 4/2013 | Lee | H01R 13/506 174/520 |
| 8,449,331 | B2 | 5/2013 | Phillips et al. | |
| 9,252,544 | B2 * | 2/2016 | Yang | H01R 13/6593 |

* cited by examiner

*Primary Examiner* — Phuong Dinh

(57) ABSTRACT

A receptacle assembly includes a receptacle housing including panels defining a pluggable module cavity and providing EMI shielding for the module cavity. A gasket assembly is provided at the bottom of the receptacle housing. The gasket assembly has a bottom plate, a hinge plate rearward of the bottom plate and a rear plate extending from a rear of the hinge plate providing EMI shielding for the module cavity. The bottom plate provides EMI shielding at the bottom of the receptacle housing and the rear plate provides EMI shielding at a back end of the receptacle housing. The hinge plate is hingedly coupled between the bottom plate and the rear plate to change relative positions of the bottom plate and the rear plate during assembly to the circuit board.

20 Claims, 6 Drawing Sheets

RECEPTACLE ASSEMBLY HAVING A GASKET ASSEMBLY FOR EMI SHIELDING

BACKGROUND OF THE INVENTION

The subject matter described herein relates to communication systems.

At least some known communication systems include receptacle assemblies, such as input/output (I/O) connector assemblies, that are configured to receive a pluggable module and establish a communicative connection between the pluggable module and an electrical connector of the receptacle assembly. As one example, a known receptacle assembly includes a receptacle housing that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable module is inserted through the opening and advanced toward the electrical connector in the cavity. The pluggable module and the electrical connector have respective electrical contacts that engage one another to establish a communicative connection. Conventional communication systems may include multiple cavities and communication connectors for mating with multiple pluggable modules.

Challenges often encountered in the design of the communication system involve assembly of the receptacle housing and the electrical connector to the circuit board. For example, the receptacle housing is typically press-fit mounted to the circuit board. However, it is difficult to provide electrical shielding around the electrical connector using the press-fit receptacle housing, unless the electrical connector is simultaneously press-fit to the circuit board with the receptacle housing. Some applications do not utilize press-fit electrical connectors or prefer to have the electrical connector pre-assembled to the circuit board prior to press-fitting the receptacle housing to the circuit board. In such systems, difficulties arise in providing shielding around the electrical connector, such as at or near the bottom of the electrical connector. For example, EMI shielding at the interface between the pluggable module and the electrical connector is difficult, such as requiring multiple pieces and multiple assembly steps. Additionally, it is difficult to provide clearance between the receptacle housing and the circuit board for the compliant pins to be properly positioned above the circuit board prior to the press-fitting operation Accordingly, there is a need for a communication system design that provides reliable EMI shielding at the mating interface between pluggable modules and the corresponding communication connectors within the receptacle housing.

BRIEF DESCRIPTION OF THE INVENTION

In an embodiment, a receptacle assembly is provided including a receptacle housing having a plurality of panels defining a module cavity configured to receive a pluggable module therein. The receptacle housing extends between a front end and a back end and is configured to receive the pluggable module through the front. At least one of the panels defines a top of the receptacle housing. The panels are conductive to provide electromagnetic interference (EMI) shielding for the module cavity. The receptacle housing is configured to be mounted to a circuit board at a bottom of the receptacle housing. A gasket assembly is provided at the bottom of the receptacle housing. The gasket assembly has a bottom plate, a hinge plate rearward of the bottom plate and a rear plate extending from a rear of the hinge plate. The bottom plate, the hinge plate and the rear plate are conductive to provide EMI shielding for the module cavity. The bottom plate is coupled to corresponding panels of the receptacle housing at the bottom of the receptacle housing to provide EMI shielding at the bottom of the receptacle housing. The rear plate is coupled to corresponding panels of the receptacle housing at the back end of the receptacle housing to provide EMI shielding at the back end of the receptacle housing. The hinge plate is hingedly coupled between the bottom plate and the rear plate to change relative positions of the bottom plate and the rear plate during assembly to the circuit board.

In another embodiment, a receptacle assembly is provided including a communication connector configured to be mounted to a circuit board. The communication connector has a front shroud holding a plurality of contacts defining a mating interface configured for mating with a pluggable module. A receptacle housing is configured to be mounted to the circuit board proximate to the communication connector. The receptacle housing has a plurality of panels defining a module cavity receiving at least a portion of the communication connector and being configured to receive the pluggable module therein for mating with the communication connector. The receptacle housing extends between a front end and a back end and is configured to receive the pluggable module through the front. At least one of the panels defines a top of the receptacle housing. The receptacle housing is configured to be mounted to the circuit board at a bottom of the receptacle housing. The panels are conductive to provide electromagnetic interference (EMI) shielding for the module cavity. A gasket assembly is provided at the bottom of the receptacle housing. The gasket assembly has a bottom plate, a hinge plate rearward of the bottom plate and a rear plate extending from a rear of the hinge plate. The bottom plate, the hinge plate and the rear plate are conductive to provide EMI shielding for the module cavity. The bottom plate is coupled to corresponding panels of the receptacle housing at the bottom of the receptacle housing to provide EMI shielding at the bottom of the receptacle housing. The rear plate has an opening receiving the front shroud of the communication connector to provide EMI shielding around the mating interface. The hinge plate is hingedly coupled between the bottom plate and the rear plate to change relative positions of the bottom plate and the rear plate during assembly to the circuit board.

In a further embodiment, a communication system is provided including a pluggable module having a pluggable body extending to a mating end. The pluggable module has a internal circuit board held in the pluggable body at the mating end. The pluggable body is conductive to provide electromagnetic interference (EMI) shielding for the internal circuit board. A communication connector is mounted to a circuit board. The communication connector has a front shroud holding a plurality of contacts defining a mating interface. The front shroud has a card receiving slot for receiving the internal circuit board of the pluggable module. A receptacle housing is mounted to the circuit board proximate to the communication connector. The receptacle housing has a plurality of panels defining a module cavity receiving at least a portion of the communication connector. The receptacle housing extends between a front end and a back end and receives the pluggable module in the module cavity through the front for mating with the communication connector. At least one of the panels defines a top of the receptacle housing. The receptacle housing is mounted to the circuit board at a bottom of the receptacle housing. The panels are conductive to provide EMI shielding for the module cavity. A gasket assembly is provided at the bottom of the receptacle housing. The gasket assembly has a bottom plate, a hinge plate rearward of the bottom plate and a rear plate extending from a rear of the hinge plate. The bottom plate, the hinge plate and the rear plate are conductive to provide EMI shielding for the module cavity. The bottom plate is coupled to corresponding panels of the receptacle housing at the bottom of the receptacle housing to provide EMI shielding at the bottom of the receptacle housing. The rear plate has an opening receiving the front shroud of the communication connector to provide EMI shielding around the mating interface. The hinge plate is hingedly coupled between the bottom plate and the rear plate to change relative positions of the bottom plate and the rear plate during assembly to the circuit board.

DETAILED DESCRIPTION OF THE INVENTION

Embodiments set forth herein include communication systems providing electromagnetic interference (EMI) shielding for the components thereof. Various embodiments of the communication system, unlike conventional systems that utilize gaskets or other shielding features at the entrance to the ports, provide EMI shielding at the mating interface between the pluggable modules and the communication connectors allowing the ports to be open defining air channels at the ports. Various embodiments of the communication system allow assembly of the receptacle housing or cage to the circuit board holding the associated communication connectors. Various embodiments of the communication system provide an expandable portion of the receptacle housing or cage to position the shielding portions relative to the communication connectors during assembly or mounting of the receptacle housing to the circuit board. In various embodiments, the bottom panel is hinged to allow positioning relative to the communication connector, which is mounted to the circuit board, prior to press-fitting the main portion of the receptacle housing to the circuit board, which may allow use with surface mounted communication connectors rather than press-fit communication connectors.

Figure 1:
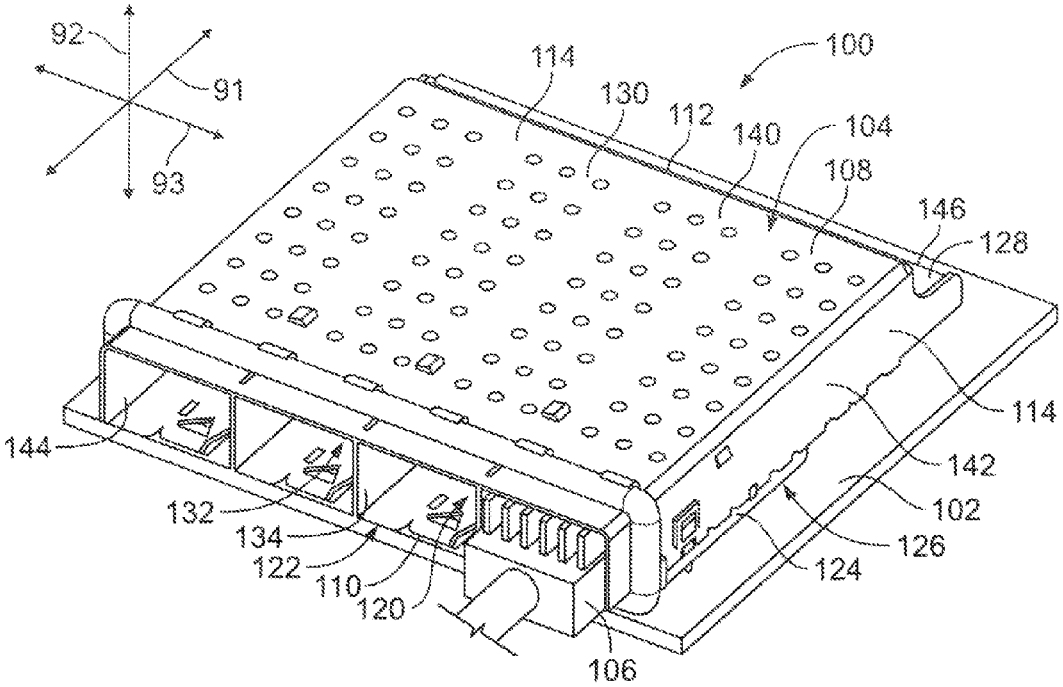
FIG. 1 is a perspective view of a communication system having a receptacle assembly and a pluggable module in accordance with an embodiment.

FIG. 1 is a perspective view of a communication system 100 in accordance with an embodiment. The communication system 100 may include a circuit board 102, a receptacle assembly 104 mounted to the circuit board 102, and one or more pluggable modules 106 that are configured to communicatively engage the receptacle assembly 104. The communication system 100 is oriented with respect to a mating or insertion axis 91, an elevation axis 92, and a lateral axis 93. The axes 91-93 are mutually perpendicular. Although the elevation axis 92 appears to extend in a vertical direction parallel to gravity in FIG. 1, it is understood that the axes 91-93 are not required to have any particular orientation with respect to gravity. Moreover, only one pluggable module 106 is shown in FIG. 1, but it is understood that multiple pluggable modules 106 may simultaneously engage the receptacle assembly 104.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate (not shown) of a chassis of the system or device, such as through an opening in the faceplate. As such, the receptacle housing 108 is interior of the device and corresponding faceplate and the pluggable module(s) 106 is loaded into the receptacle housing 108 from outside or exterior of the device and corresponding faceplate.

The receptacle housing 108 includes a front end 110 and an opposite back end 112. The front end 110 may be provided at, and extend through an opening in, the faceplate. The mating axis 91 may extend between the front and back ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The receptacle housing 108 is configured to contain or block electromagnetic interference (EMI) and guide the pluggable module(s) 106 during a mating operation. To this end, the receptacle housing 108 includes a plurality of conductive housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. The air may flow from inside the receptacle housing 108 (for example, behind the faceplate) to the external environment (for example, forward of the faceplate) or from outside the receptacle housing 108 into the interior of the receptacle housing 108. Fans or other air moving devices may be used to increase airflow through the receptacle housing 108 and over the pluggable module(s) 106. The housing walls 114 may include openings to allow airflow therethrough. The openings may be sized small enough such that the housing walls 114 provide effective EMI shielding.

In the illustrated embodiment, the receptacle housing 108 includes a single row of elongated module cavities 120; however the receptacle housing 108 may have multiple, stacked rows of module cavities, such as an upper row and a lower row. Each of the module cavities 120 extends lengthwise in a direction that is parallel to the mating axis 91 between the front and back ends 110, 112. The module cavities 120 have respective openings or ports 122 at the front end 110 that are sized and shaped to receive corresponding pluggable modules 106. Any number of module cavities 120 may be arranged side-by-side, including a single module cavity 120.

In an exemplary embodiment, the module cavities 120 include airflow channels at the front end 110 to allow airflow therethrough along the pluggable modules 106, such as along top surfaces of the pluggable modules 106, to enhance heat transfer of the pluggable modules 106 located in the module cavities 120.

In an exemplary embodiment, the receptacle assembly 104 includes a gasket assembly 124 at a bottom 126 of the receptacle housing 108. The gasket assembly 124 provides EMI shielding at the bottom 126. The receptacle assembly 104 includes communication connectors 128 (also shown in FIGS. 5 and 6) at the back end 112. The pluggable modules 106 are mated with the communication connectors 128. In an exemplary embodiment, EMI shielding is provided at the communication connectors 128 to provide electrical shielding at the interface with the pluggable modules 106. For example, one or more gaskets may be provided by the gasket assembly 124 at the mating interfaces. The EMI shielding is electrically connected to the conductive housing walls 114 of the receptacle housing 108 to electrically common the EMI shielding of the gasket assembly 124 with the other portions of the receptacle housing 108.

The gasket assembly 124 simplifies assembly or mounting of the receptacle housing 108 to the circuit board 102, such as to communication connectors 128 mounted to the circuit board 102, as described in further detail below. The gasket assembly 124 may be pre-assembled to the receptacle housing 108 prior to mounting to the circuit board 102 and the communication connectors 128 mounted to the circuit board 102. In an exemplary embodiment, the gasket assembly 124 allows press-fit assembly of the receptacle housing 108 to the circuit board 102 over pre-mounted communication connectors 128, such as communication connectors 128 previously surface mounted to the circuit board 102. The gasket assembly 124 allows positioning of EMI shielding components at the mating interface of the communication connectors 128 while vertical loading of the receptacle housing 108 in a downward direction over the communication connectors 128, such as during a press-fit mounting process to the circuit board 102.

The housing walls 114 of the receptacle housing 108 are formed from a plurality of interconnected panels 130 or sheets. The panels 130 surround a housing cavity 132. The gasket assembly 124 may be mechanically and electrically connected to corresponding panels 130 along the bottom 126 to close the bottom of the housing cavity 132. The receptacle housing 108 may include one or more interior panels 134 that define separator panels between adjacent module cavities 120. The interior panels 134 may be mechanically and electrically connected to the gasket assembly 124 when assembled. The panels 130 and the interior panels 134 may be stamped and formed from sheet metal to provide EMI shielding for the pluggable modules 106. The interior panels 134 may be oriented generally vertically within the housing cavity 132 to partition the housing cavity 132 into the module cavities 120. The interior panels 134 may extend generally parallel to the mating axis 91 at least partially between the front end 110 and the back end 112. The receptacle housing 108 may include separator panels (not shown) that extend horizontally between upper and lower module cavities.

In an exemplary embodiment, the panels 130 include a top panel 140, side panels 142, 144, and a rear panel 146 formed integral with each other (for example, to define a top wall, side walls and a rear wall, respectively); however any of such panels 130 may be discrete from other panels 130 and coupled to the other panels 130. The side panels 142, 144 and the rear panel 146 may be mechanically and electrically connected to the gasket assembly 124 when assembled.

The panels 130, the interior panels 134, and the gasket assembly 124 may comprise conductive material, such as metal. When the receptacle assembly 104 is mounted to the circuit board 102, the receptacle housing 108 and the gasket assembly 124 are electrically coupled to the circuit board 102 and, in particular, to ground planes (not shown) within the circuit board 102 to electrically ground the receptacle housing 108 and the gasket assembly 124. As such, the receptacle assembly 104 may reduce EMI leakage that may negatively affect electrical performance of the communication system 100.

The pluggable module 106 is an input/output (I/O) module configured to be inserted into and removed from the receptacle assembly 104. The pluggable module 106 is configured to be inserted into the module cavity 120 of the receptacle housing 108 and advanced in a mating direction along the mating axis 91 for mating with the corresponding communication connector 128. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

Figure 2:
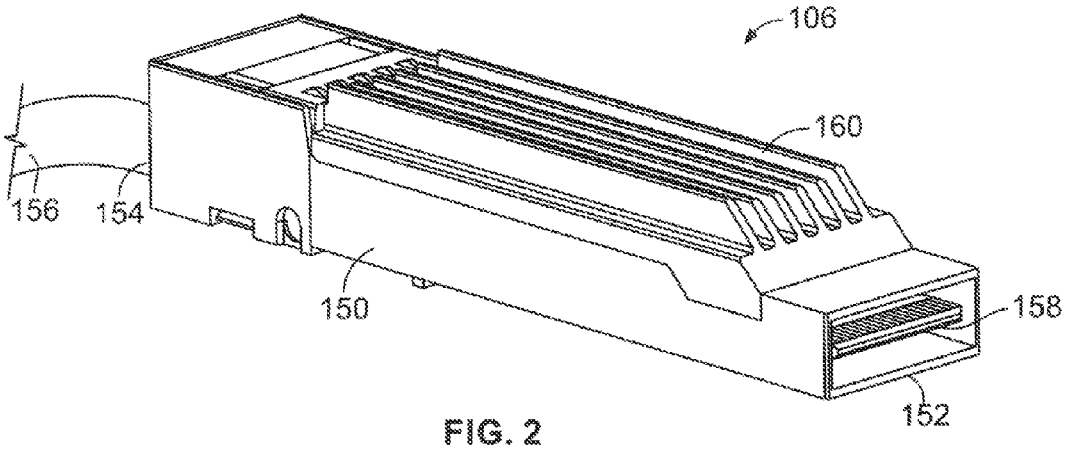
FIG. 2 is a perspective view of the pluggable module.

FIG. 2 is a perspective view of the pluggable module 106 in accordance with an exemplary embodiment. In some embodiments, the pluggable module 106 is an input/output cable assembly having a pluggable body 150. The pluggable body 150 includes a mating end 152 and an opposite cable end 154. A cable 156 is coupled to the pluggable body 150 at the cable end 154. The pluggable body 150 also includes an internal circuit board 158 that is communicatively coupled to electrical wires or optical fibers (not shown) of the cable 156. The internal circuit board 158 may be exposed at the mating end 152 for mating with the communication connector 128 (shown in FIG. 5). The cable 156 may be communicatively coupled by directly terminating the electrical wires to the internal circuit board 158, such as by soldering the electrical wires to the internal circuit board. Alternatively, the cable 156 may be communicatively coupled by other processes, such as by using connectors at the end of the cable 156 and on the internal circuit board 158. The internal circuit board 158 is supported by the pluggable body 150.

In an exemplary embodiment, the pluggable body 150 is manufactured from a conductive material, such as a metal material. The pluggable body 150 provides EMI shielding for the circuit board 158. Optionally, the pluggable body 150 may provide heat transfer for the internal circuit board 158, such as for the electronic components on the internal circuit board 158. For example, the internal circuit board 158 is in thermal communication with the pluggable body 150 and the pluggable body 150 transfers heat from the internal circuit board 158. In an exemplary embodiment, the heat is transferred from at or near the mating end 152, such as where various electrical components are located on the internal circuit board 158, to the cable end 154. In the illustrated embodiment, the mating end 152 is flat; however the mating end 152 may be angled in various embodiments. The heat is pulled out of the receptacle assembly 104 and mating end 152 and rejected to the external environment forward of the faceplate. In other embodiments, the heat may be drawn into other portions of the pluggable body 150 and/or the heat may be directed to other portions of the pluggable body 150, such as to the mating end 152 where the heat may be transferred to another heat sink or heat transferring component inside the chassis.

In an exemplary embodiment, the pluggable body 150 includes a plurality of fins 160 extending therefrom. The fins 160 increase the surface area of the pluggable body 150 and allow greater heat transfer therefrom. The fins 160 may extend from any portion of the pluggable body 150, such as the top, the sides and/or the bottom. In the illustrated embodiment, the fins 160 are parallel plates with airflow channels therebetween. The plates may extend continuously between opposite ends of the fins 160. In alternative embodiments, other types of fins 160 may be used, such as fins 160 in the form of pins or posts extending from the pluggable body 150. The pin-shaped fins 160 may be arranged in rows and columns and may be separated from each other to allow airflow around the pins and between the various pins.

Figure 3:
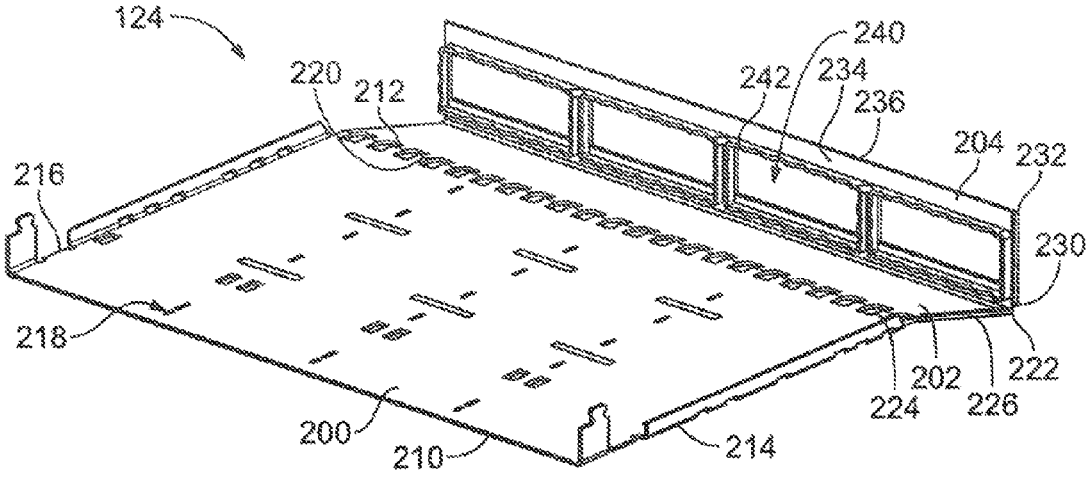
FIG. 3 is a front perspective view of a gasket assembly of the receptacle assembly in accordance with an exemplary embodiment.
Figure 4:
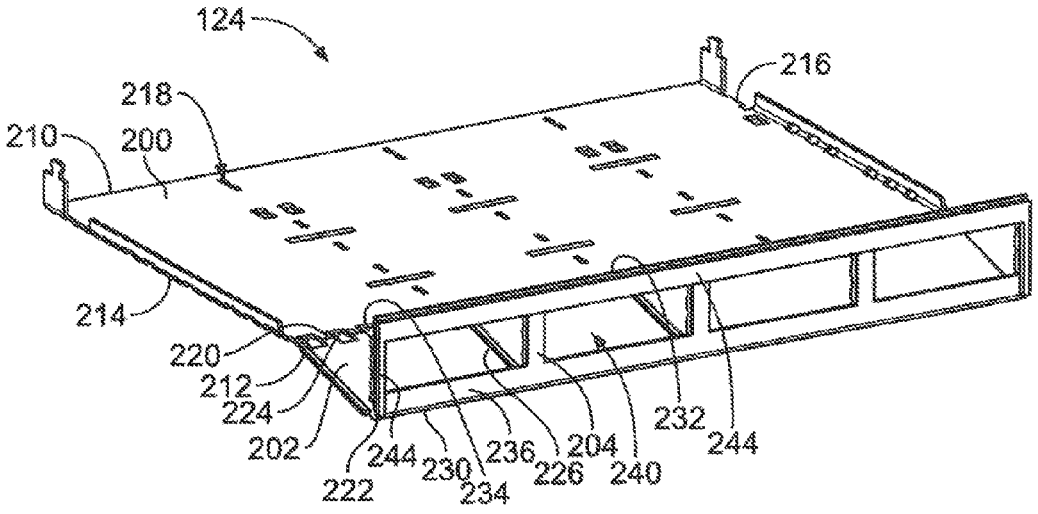
FIG. 4 is a rear perspective view of the gasket assembly.

FIG. 3 is a front perspective view of the gasket assembly 124 in accordance with an exemplary embodiment. FIG. 4 is a rear perspective view of the gasket assembly 124 in accordance with an exemplary embodiment. The gasket assembly 124 includes a bottom plate 200, a hinge plate 202 rearward of the bottom plate 200, and a rear plate 204 extending from the hinge plate 202. The gasket assembly 124 may include additional plates in other embodiments. The plates 200, 202, 204 are conductive to provide EMI shielding for the module cavity 120 (shown in FIG. 1). In an exemplary embodiment, the plates 200, 202, 204 are integral, being stamped and formed from a common sheet.

The bottom plate 200 is configured to be coupled to corresponding panels 130 (shown in FIG. 1) of the receptacle housing 108 at the bottom 126 of the receptacle housing 108 to provide EMI shielding at the bottom 126 of the receptacle housing 108. The rear plate 204 is configured to be coupled to corresponding panels 130 of the receptacle housing 108 at the back end 112 of the receptacle housing 108 to provide EMI shielding at the back end 112 of the receptacle housing 108. The hinge plate 202 is hingedly coupled between the bottom plate 200 and the rear plate 204 to change relative positions of the bottom plate 200 and the rear plate 204 during assembly to the circuit board 102 (shown in FIG. 1). In an exemplary embodiment, the hinge plate 202 is configured to be coupled to corresponding panels 130 of the receptacle housing 108 at the bottom 126 to provide EMI shielding at the bottom 126 of the receptacle housing 108. For example, the hinge plate 202 may be the rearward most portion of the bottom plate 200.

The bottom plate 200 extends between a front 210 and a rear 212. The bottom plate 200 has opposite sides 214, 216. Optionally, the bottom plate 200 may be oriented generally horizontally. For example, the bottom plate 200 may be oriented within a plane parallel to a plane defined by the mating axis 91 and the lateral axis 93. In an exemplary embodiment, the bottom plate 200 includes a plurality of openings 218 therethrough, which may receive compliant pins of the panels 130 for press-fit mounting the panels 130 to the circuit board 102. The sides 214, 216 are configured to be coupled to the side panels 142, 144 (shown in FIG. 1), respectively, of the receptacle housing 108. Optionally, portions of the sides 214, 216 may be folded upward to wrap around portions of the side panels 142, 144. Alternatively, rather than wrapping the sides 214, 216 upward along the side panels 142, 144, the sides 214, 216 may end at the side panels 142, 144 or the side panels 142, 144 may wrap around the sides 214, 216.

The hinge plate 202 extends between a front 220 and a rear 222. The front 220 may be hingedly coupled to the rear 212 of the bottom plate 200. The rear plate 204 may extend from the rear 222 of the hinge plate 202. The hinge plate 202 may be hingedly coupled to the rear plate 204 at the rear 222. In an exemplary embodiment, flexible beams 224 may be provided at the hinge between the hinge plate 202 and the bottom plate 200 and/or between the hinge plate 202 and the rear plate 204. The flexible beams 224 may be formed by stamping sections of the sheet to remove such sections leaving the flexible beams 224 between the plates 200, 202, 204.

In an exemplary embodiment, the hinge plate 202 includes a plurality of gaskets 226 on the interior surface thereof. The gaskets 226 are configured to interface with corresponding panels 130 of the receptacle housing 108, such as the side panels 142, 144 and the interior panels 134. Optionally, the gaskets 226 may interface with the communication connectors 128 (shown in FIG. 5).

In an exemplary embodiment, the hinge plate 202 is angled downward relative to the bottom plate 200. As such, the rear 222 of the hinge plate 202 is positioned below the rear 212 of the bottom plate 200. Angling the hinge plate 202 downward positions the rear plate 204 at a downward position, such as for interfacing with the communication connectors 128, as described in further detail below. During assembly to the circuit board 102, the hinge plate 202 may be pivoted to change the relative positions of the bottom plate 200 with respect to the rear plate 204. For example, the bottom plate 200 may be lowered by pivoting the hinge plate 202 with respect to both the bottom plate 200 and the rear plate 204. In an exemplary embodiment, the hinge plate 202 is moved between an angled position (shown in FIGS. 3 and 4) and a generally flat position, in which the hinge plate 202 is generally coplanar with the bottom plate 200. The relative vertical and horizontal positions of the rear plate 204 and the bottom plate 200 are changed as the hinge plate 202 moves between the angled position and the flat position.

The rear plate 204 extends from the hinge plate 202. The rear plate 204 includes a bottom 230 and a top 232. The bottom 230 may be hingedly coupled to the rear 222 of the hinge plate 202. Optionally, the rear plate 204 may be oriented generally vertically. For example, the rear plate 204 may be oriented generally parallel to the elevation axis 92. The rear plate 204 includes an interior surface 234 and an exterior surface 236. The interior surface 234 faces the module cavities 120. The interior surface 234 faces forward, such as facing the hinge plate 202 and the bottom plate 200. The exterior surface 236 may face rearward, such as to face a portion of the communication connectors 128 and/or a portion of the rear panel 146 (shown in FIG. 1).

The rear plate 204 includes a plurality of openings 240. The openings 240 are configured to receive portions of the communication connectors 128. In an exemplary embodiment, the rear plate 204 includes module gaskets 242 at least partially surrounding the openings 240. The module gaskets 242 are provided on the interior surface 234. Optionally, the module gaskets 244 may extend through the openings 240. The module gaskets 242 may surround and/or engage portions of the pluggable module 106 (shown in FIG. 2), such as the mating end 152 (shown in FIG. 2) of the pluggable module 106. The module gaskets 242 may at least partially surround and/or engage portions of the communication connectors 128. The module gaskets 242 provide EMI shielding for the pluggable module 106 and/or the communication connectors 128. For example, the module gaskets 242 may provide EMI shielding at or near the mating interface between the pluggable modules 106 and the communication connectors 128. In an exemplary embodiment, the rear plate 204 includes one or more rear gaskets 244 on the exterior surface 236. The rear gaskets 244 may engage corresponding panels 130 of the receptacle housing 108. For example the rear gaskets 244 may engage the rear panel 146. The rear gaskets 244 may engage portions of the communication connectors 128.

Figure 5:
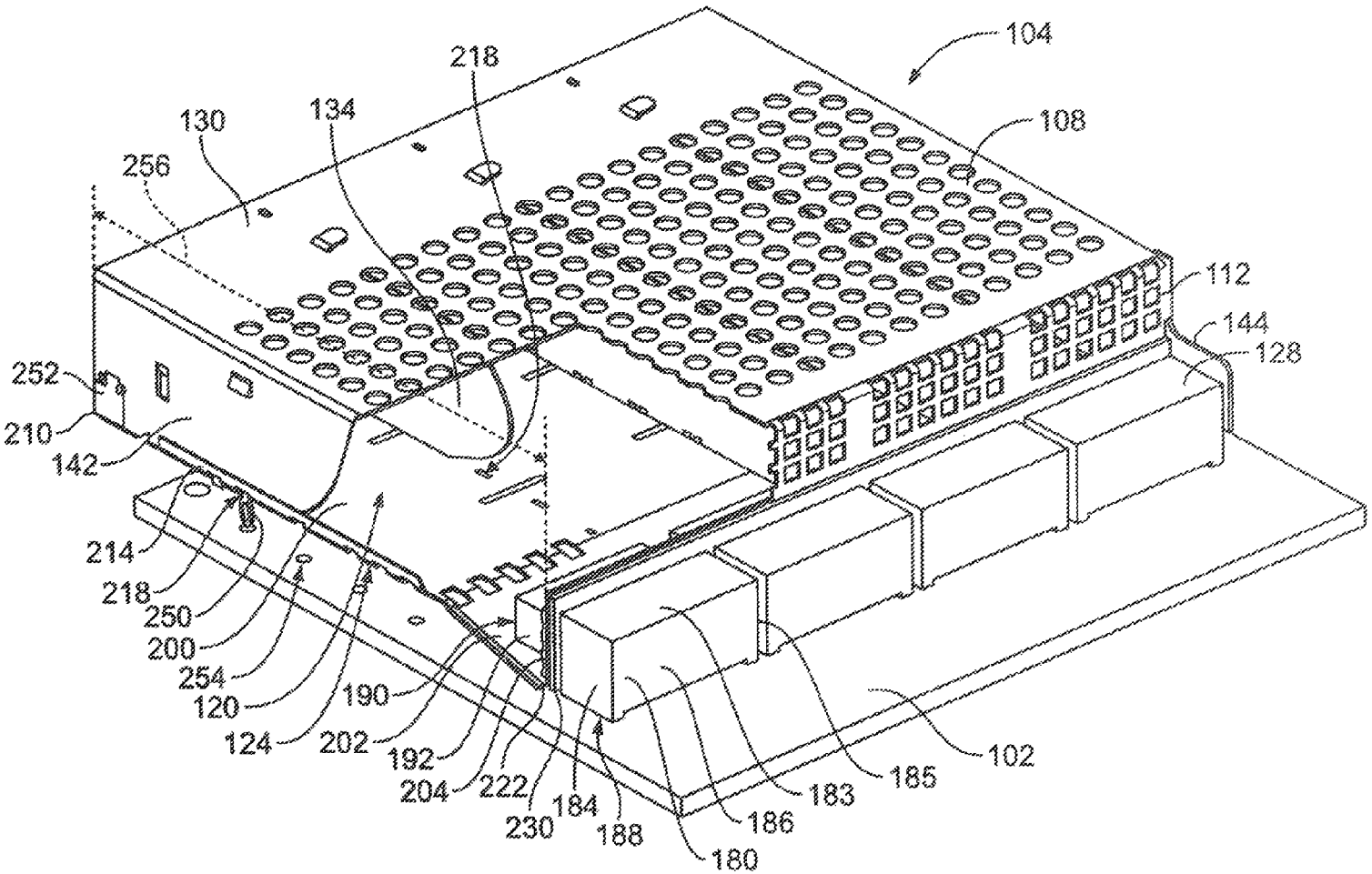
FIG. 5 is a rear perspective, partial sectional view of the receptacle assembly showing a receptacle housing and the gasket assembly poised for mounting to a circuit board.
Figure 6:
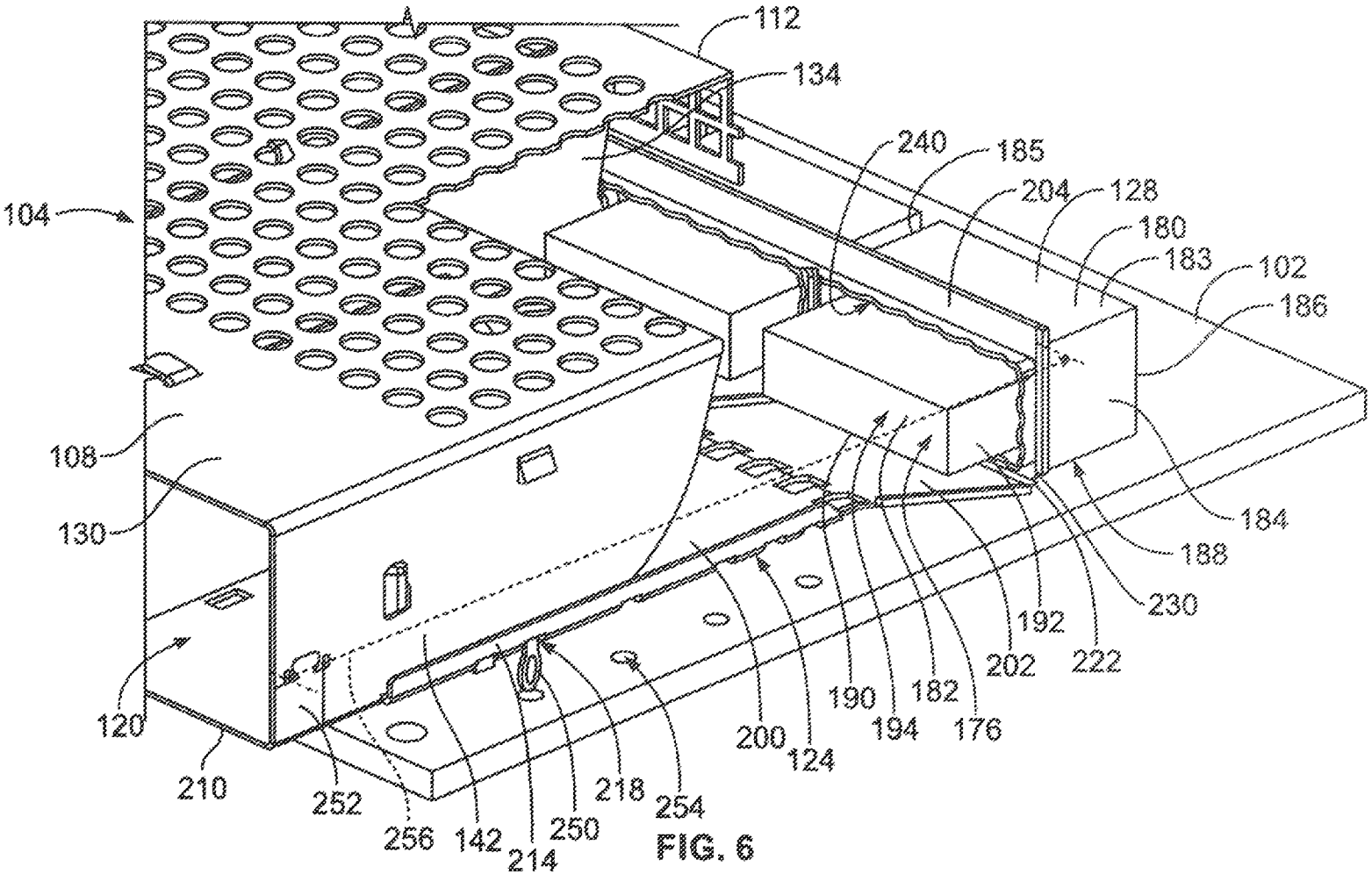
FIG. 6 is a front perspective, partial sectional view of a portion of the receptacle assembly showing the receptacle housing and gasket assembly poised for mounting to the circuit board.

FIG. 5 is a rear perspective, partial sectional view of the receptacle assembly 104 showing the receptacle housing 108 and gasket assembly 124 poised for mounting to the circuit board 102. FIG. 6 is a front perspective, partial sectional view of a portion of the receptacle assembly 104 showing the receptacle housing 108 and gasket assembly 124 poised for mounting to the circuit board 102. FIGS. 5 and 6 show the communication connectors 128 mounted to the circuit board 102. In an exemplary embodiment, the communication connectors 128 are mounted to the circuit board 102 prior to mounting the receptacle housing 108 and the gasket assembly 124 to the circuit board 102. The gasket assembly 124 allows the receptacle housing 108 to be mounted over the pre-mounted communication connectors 128.

Optionally, the communication connectors 128 may be identical; however, the communication connectors 128 may have different features in alternative embodiments. In an exemplary embodiment, the communication connector 128 has a mating interface 176 for interfacing with the corresponding pluggable module 106 (shown in FIG. 2); however the communication connector 128 may include multiple mating interfaces, such as stacked mating interfaces for use with multi-row receptacle housings. The mating interface 176 is configured to be disposed within the module cavity 120 for mating engagement with the pluggable module 106.

The communication connector 128 includes a housing 180 that holds contacts 182. Optionally, the contacts 182 may be part of contact modules, such as overmolded leadframes, which may be loaded into the housing 180. Alternatively, the contacts 182 may be directly held by the housing 180, such as being stitched into the housing 180 through the rear or from the bottom. The housing 180 includes a top 183, first and second sides 184, 185, a rear 186, a mounting face 188 configured to be mounted to the circuit board 102 (shown in FIG. 1), and a mating face 190 opposite the rear 186 (in the illustrated embodiment, the mounting face 188 defines a bottom 188 of the communication connector 128 and the mating face 190 defines a front 190 of the communication connector 128).

The housing 180 includes a front shroud 192 at the mating face 190. The shroud 192 may be a generally box-shaped extension. The shroud 192 may have other surfaces to have other shapes in alternative embodiments. The shroud has a card receiving slot 194 at the mating face 190. The card receiving slot 194 is configured to receive the card edge of the circuit board 158 (shown in FIG. 2) of the corresponding pluggable module 106. The contacts 182 are held by the housing 180 and are exposed within the card receiving slot 194 for mating with the corresponding pluggable module 106. The contacts 182 and the card receiving slot 194 define the mating interface 176. The contacts 182 are arranged to define an upper contact array and a lower contact array configured for interfacing with upper and lower surfaces of the circuit board 158. The contacts 182 may be signal contacts, ground contacts or other types of contacts and the contacts 182 may be in any arrangement, such as a ground-signal-signal-ground arrangement with a pair of signal contacts flanked by ground contacts. The contacts 182 are provided at the mounting face 188 for termination to the circuit board 102. For example, ends of the contacts 182 may constitute solder tabs configured to be surface mounted to the circuit board 102, such as using solder paste. Alternatively, the ends of the contacts 182 may be compliant pins, such as eye-of-the-needle pins that are loaded into plated vias of the circuit board 102.

During assembly, the gasket assembly 124 is coupled to the receptacle housing 108. For example, compliant pins 250 extending from the panels 130, such as the side panels 142, 144 and the interior panels 134, may pass through corresponding openings 218 (best seen in FIGS. 3 and 4) in the bottom plate 200 to mechanically and electrically connect the bottom plate 200 to the receptacle housing 108. The sides 214, 216 (FIGS. 3 and 4) may wrap around the side panels 142, 144. Tabs 252 may be used to secure the gasket assembly 124 to the receptacle housing 108.

Once the gasket assembly 124 is coupled to the receptacle housing 108, the gasket assembly 124 and receptacle housing 108 may be positioned relative to the circuit board 102 and relative to the communication connectors 128. For example, the compliant pins 250 may be aligned with corresponding vias 254 in the circuit board 102 (for example, aligned vertically above the vias 254). The compliant pins 250 are configured to be press-fit into the plated vias 254 to electrically connect the receptacle housing 108 to a ground plane of the circuit board 102. The compliant pins 250 may be pressed vertically downward into the vias 254, such as in a direction parallel to the elevation axis 92 (FIG. 1). The receptacle housing 108 is pressed vertically downward during the press-fitting operation to mount the receptacle housing 108 to the circuit board 102. As such, the compliant pins 250 and the bottom plate 200 are vertically aligned directly above the mounting area of the circuit board 102 immediately prior to the press-fitting operation.

In an exemplary embodiment, the communication connectors 128 are pre-assembled to the circuit board 102. For example, the communication connectors 128 may be surface mounted or press-fit mounted to the circuit board 102 prior to mounting the receptacle housing 108 to the circuit board 102. The receptacle housing 108 must be positioned relative to the communication connectors 128 prior to mounting the receptacle housing to the circuit board 102. For example, the front shrouds 192 of the communication connectors 128 are configured to pass through the openings 240 in the rear plate 204 for interfacing with the pluggable modules 106 (shown in FIG. 2). As such, portions of the communication connectors 128 are arranged within the module cavity 120. However, the back ends of the communication connectors 128 are provided exterior of the back end 112 of the receptacle housing 108. The back ends of the communication connectors 128 are exterior of the module cavities 120. Only the front shroud 192 passes through the rear plate 204 into the module cavities 120.

During assembly, prior to press-fitting the receptacle housing to the circuit board 102, the bottom 230 of the rear plate 204 must be positioned at a lower position relative to the bottom plate 200, such as at the circuit board 102, to surround the front shrouds 192, while the bottom plate 200 must be elevated at a higher position relative to the bottom 230 of the rear plate 204, such as spaced above the circuit board 102, to provide a clearance space for positioning the compliant pins 250 above the vias 254. The hinge plate 202 accommodates the lower positioning of the rear plate 204 and the higher positioning of the bottom plate 200 prior to assembly to the circuit board 102. For example, the hinge plate 202 is angled between the bottom 230 of the rear plate 204, which is at the lower position, and the bottom plate 200, which is at the elevated position.

As the receptacle housing 108 is pressed downward onto the circuit board 102, the hinge plate 202 pivots between the angled position and the flat position. As the receptacle housing 108 is pushed downward and the hinge plate 202 is pivoted and flattened out, the rear plate 204 is pushed rearward by the hinge plate 202. For example, the rear plate 204 slides rearward along the front shrouds 192 toward the back ends of the communication connectors 128. A distance 256 between the front 210 of the bottom plate 200 and the rear plate 204 is variable as the hinge plate 202 pivots during assembly to the circuit board 102. For example, as the hinge plate 202 flattens out and the rear plate 204 is pushed rearward, the distance 256 between the front 210 of the bottom plate 200 and the rear 222 of the hinge plate 202 increases.

In an exemplary embodiment, the rear plate 204 is configured to be vertically fixed and horizontally moveable relative to the circuit board 102 during assembly of the receptacle housing 108 to the circuit board 102. The bottom plate 200 is configured to be horizontally fixed (for example, with the compliant pins 250 aligned with the vias 254) and vertically moveable downward toward the circuit board 102 during assembly of the receptacle housing 108 to the circuit board 102. The hinge plate 202 allows the relative vertical and horizontal movements of the bottom plate 200 and the rear plate 204, respectively.

Figure 7:
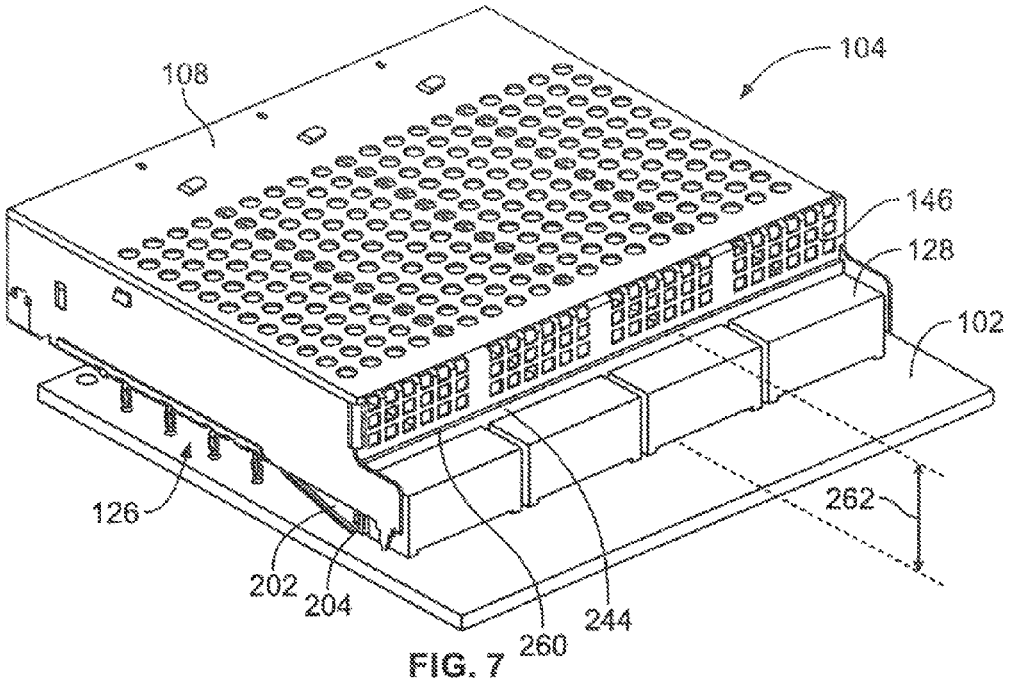
FIG. 7 is a rear perspective view of the receptacle assembly showing the receptacle housing poised for mounting to the circuit board.
Figure 8:
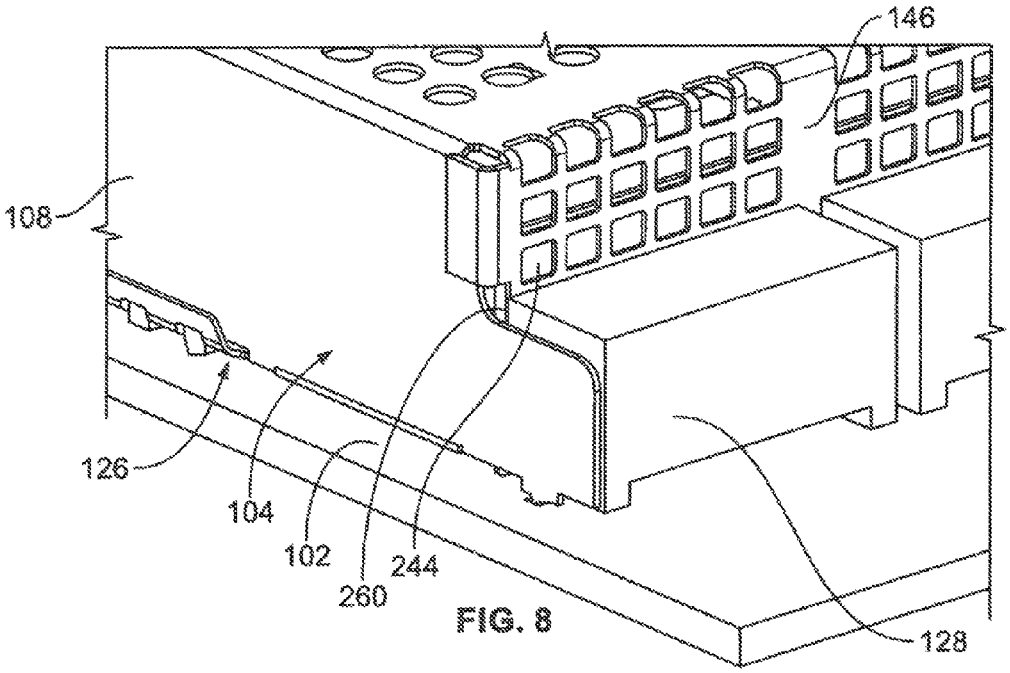
FIG. 8 is a rear perspective view of a portion of the receptacle assembly showing the receptacle housing mounted to the circuit board.
Figure 9:
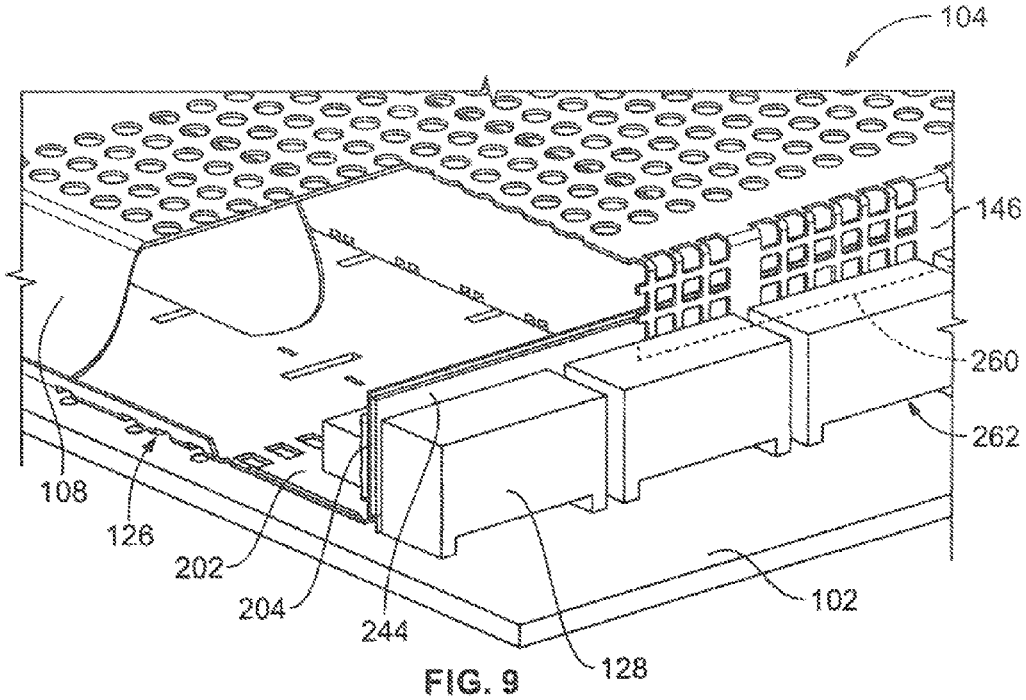
FIG. 9 is a partial-sectional view of a portion of the receptacle assembly showing the receptacle housing mounted to the circuit board.

FIG. 7 is a rear perspective view of the receptacle assembly 104 showing the receptacle housing 108 poised for mounting to the circuit board 102. FIG. 8 is a rear perspective view of a portion of the receptacle assembly 104 showing the receptacle housing 108 mounted to the circuit board 102. FIG. 9 is a partial-sectional view of a portion of the receptacle assembly 104 showing the receptacle housing 108 mounted to the circuit board 102.

When the receptacle housing 108 is aligned with the mounting area of the circuit board 102, the rear panel 146 of the receptacle housing 108 is aligned above the communication connectors 128. Portions of the communication connectors 128 extend rearward of the rear panel 146. As the receptacle housing 108 is press-fit onto the circuit board 102, the rear panel 146 is pressed downward toward the communication connectors 128. In the assembled position (FIG. 8), a bottom 260 of the rear panel 146 is positioned above the communication connectors 128 and spaced apart from the bottom 126 of the receptacle housing 108. A space 262 is defined between the top of the circuit board 102 and the bottom 260 of the rear panel 146. The communication connectors 128 are positioned in the space 262. In an exemplary embodiment, the rear plate 204 is used to close the space 262 between the rear panel 146 and the circuit board 102.

In an exemplary embodiment, the rear plate 204 engages the rear panel 146 to electrically connect the rear plate 204 to the rear panel 146. For example, the rear gaskets 244 may directly engage the rear panel 146. In an exemplary embodiment, as described above, the rear plate 204 is shifted rearward as the receptacle housing 108 is press-fit onto the circuit board 102. For example, the hinge plate 202 presses the rear plate 204 rearward as the hinge plate 202 is flattened out. The hinge plate 202 presses the rear plate 204 rearward against the rear panel 146 during assembly. For example, when the hinge plate 202 is in the angled position (FIG. 7), the rear plate 204 is offset forward of the rear panel 146. However, in the assembled position (FIG. 9), the rear plate 204 is pressed against the rear panel 146.

Figure 10:
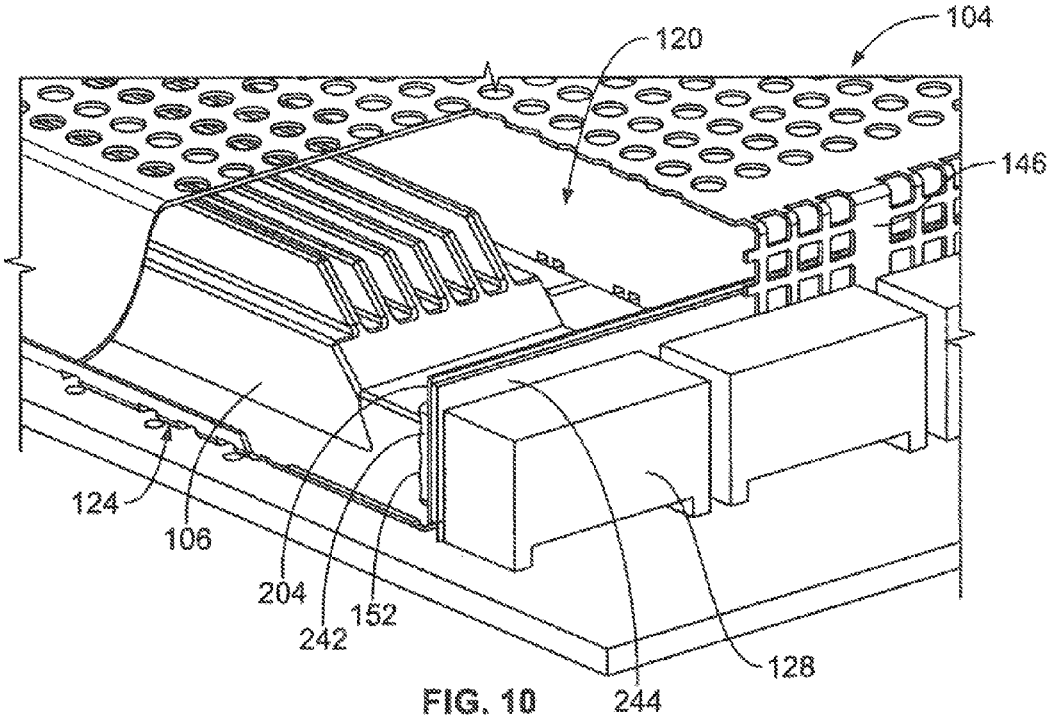
FIG. 10 is a partial-sectional view of a portion of the receptacle assembly showing the pluggable module mated to a communication connector.

FIG. 10 is a partial-sectional view of a portion of the receptacle assembly 104 showing the pluggable module 106 mated to the communication connector 128. The pluggable module 106 is loaded into the module cavity 120 in a mating direction to mate with the communication connector 128. The mating end 152 of the pluggable module 106 receives the front shroud 192 (shown in FIG. 6) of the communication connector 128 and the mating end 152 engages the module gasket 242. The module gasket 242 provides EMI shielding at the mating interface between the pluggable module 106 and the communication connector 128.

In an exemplary embodiment, when the pluggable module 106 is fully mated in the module cavity 120, the pluggable module 106 may press against the rear plate 204 of the gasket assembly 124. The pluggable module 106 may press the rear plate 204 rearward against the rear panel 146. For example, the rear gasket 244 may be compressed between the rear plate 204 and the rear panel 146 by rearward pressure induced by the pluggable module 106 ensuring an electrical connection is maintained between the rear plate 204 and the rear panel 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A receptacle assembly comprising:

a receptacle housing having a plurality of panels defining a module cavity configured to receive a pluggable module therein, the receptacle housing extending between a front end and a back end and being configured to receive the pluggable module through the front end, at least one of the panels defining a top of the receptacle housing, the panels being conductive to provide electromagnetic interference (EMI) shielding for the module cavity, the receptacle housing configured to be mounted to a circuit board at a bottom of the receptacle housing;

a gasket assembly provided at the bottom of the receptacle housing, the gasket assembly having a bottom plate, a hinge plate rearward of the bottom plate, and a rear plate extending from a rear of the hinge plate, the bottom plate, the hinge plate and the rear plate being conductive to provide EMI shielding for the module cavity, the bottom plate being coupled to corresponding panels of the receptacle housing at the bottom of the receptacle housing to provide EMI shielding at the bottom of the receptacle housing, the rear plate being coupled to corresponding panels of the receptacle housing at the back end of the receptacle housing to provide EMI shielding at the back end of the receptacle housing, the hinge plate is hingedly coupled between the bottom plate and the rear plate to change relative positions of the bottom plate and the rear plate during assembly to the circuit board.

2. The receptacle assembly of claim 1, wherein the bottom plate extends between a front and a rear, a distance between the front of the bottom plate and the rear plate being variable as the hinge plate pivots during assembly to the circuit board.

3. The receptacle assembly of claim 1, wherein the rear plate is pushed rearward by the hinge plate during assembly to the circuit board.

4. The receptacle assembly of claim 1, wherein the hinge plate is moveable between an angled position and a flat position during assembly to the circuit board, the hinge plate being generally coplanar with the bottom plate in the flat position.

5. The receptacle assembly of claim 1, wherein the rear plate is configured to be vertically fixed and horizontally moveable relative to the circuit board during assembly of the receptacle housing to the circuit board, the bottom plate being configured to be horizontally fixed and vertically moveable relative to the circuit board during assembly of the receptacle housing to the circuit board, the hinge plate allowing the relative vertical and horizontal movements of the bottom plate and the rear plate, respectively.

6. The receptacle assembly of claim 1, wherein the bottom plate is fixed relative to the receptacle housing, the hinge plate and the rear plate being movable relative to the receptacle housing.

7. The receptacle assembly of claim 1, wherein the hinge plate is connected to the bottom plate by a plurality of flexible beams.

8. The receptacle assembly of claim 1, wherein the bottom plate, the hinge plate and the rear plate are integral being stamped and formed from a common sheet.

9. The receptacle assembly of claim 1, wherein the rear plate includes an opening and a gasket at least partially surrounding the opening, the opening being configured to receive at least a portion of a communication connector configured to be mated with the pluggable module, the gasket providing EMI shielding at a mating interface between the pluggable module and the communication connector.

10. The receptacle assembly of claim 1, wherein at least one of the panels of the receptacle housing defines a rear panel at the back end of the receptacle housing, the rear plate engaging the rear panel to close the module cavity at the back end.

11. The receptacle assembly of claim 10, wherein the rear panel is configured to be positioned above a communication connector mounted to the circuit board and being spaced apart from the bottom, the rear plate surrounding the communication connector to close the space between the rear plate and the circuit board to provide EMI shielding at the back end of the receptacle housing.

12. The receptacle assembly of claim 10, wherein the rear plate is slid rearward toward the rear panel as the rear panel is moved downward toward the circuit board during assembly of the receptacle housing to the circuit board.

13. The receptacle assembly of claim 1, wherein at least some of the panels of the receptacle housing have compliant pins extending downward therefrom and passing through the bottom plate for press-fit mounting to the circuit board.

14. The receptacle assembly of claim 1, wherein the hinge plate includes a gasket configured to engage at least one of the panels of the receptacle housing to provide EMI shielding for the module cavity.

15. A receptacle assembly comprising:

a communication connector configured to be mounted to a circuit board, the communication connector having a front shroud holding a plurality of contacts defining a mating interface configured for mating with a pluggable module;

a receptacle housing configured to be mounted to the circuit board proximate to the communication connector, the receptacle housing having a plurality of panels defining a module cavity receiving at least a portion of the communication connector and being configured to receive the pluggable module therein for mating with the communication connector, the receptacle housing extending between a front end and a back end and being configured to receive the pluggable module through the front end, at least one of the panels defining a top of the receptacle housing, the receptacle housing configured to be mounted to the circuit board at a bottom of the receptacle housing, the panels being conductive to provide electromagnetic interference (EMI) shielding for the module cavity;

a gasket assembly provided at the bottom of the receptacle housing, the gasket assembly having a bottom plate, a hinge plate rearward of the bottom plate, and a rear plate extending from a rear of the hinge plate, the bottom plate, the hinge plate and the rear plate being conductive to provide EMI shielding for the module cavity, the bottom plate being coupled to corresponding panels of the receptacle housing at the bottom of the receptacle housing to provide EMI shielding at the bottom of the receptacle housing, the rear plate having an opening receiving the front shroud of the communication connector to provide EMI shielding around the mating interface, the hinge plate is hingedly coupled between the bottom plate and the rear plate to change relative positions of the bottom plate and the rear plate during assembly to the circuit board.

16. The receptacle assembly of claim 15, wherein the bottom plate extends between a front and a rear, a distance between the front of the bottom plate and the rear plate being variable as the hinge plate pivots during assembly to the circuit board.

17. The receptacle assembly of claim 15, wherein the rear plate is pushed rearward by the hinge plate during assembly to the circuit board.

18. The receptacle assembly of claim 15, wherein the hinge plate is moveable between an angled position and a flat position during assembly to the circuit board, the hinge plate being generally coplanar with the bottom plate in the flat position.

19. The receptacle assembly of claim 15, wherein the rear plate is configured to be vertically fixed and horizontally moveable relative to the circuit board during assembly of the receptacle housing to the circuit board, the bottom plate being configured to be horizontally fixed and vertically moveable relative to the circuit board during assembly of the receptacle housing to the circuit board, the hinge plate allowing the relative vertical and horizontal movements of the bottom plate and the rear plate, respectively.

20. A communication system comprising:

a pluggable module having a pluggable body extending to a mating end, the pluggable module having an internal circuit board held in the pluggable body at the mating end, the pluggable body being conductive to provide electromagnetic interference (EMI) shielding for the internal circuit board;

a communication connector mounted to a circuit board, the communication connector having a front shroud holding a plurality of contacts defining a mating interface, the front shroud having a card receiving slot receiving the internal circuit board of the pluggable module;

a receptacle housing mounted to the circuit board proximate to the communication connector, the receptacle housing having a plurality of panels defining a module cavity receiving at least a portion of the communication connector, the receptacle housing extending between a front end and a back end and receiving the pluggable module in the module cavity through the front end for mating with the communication connector, at least one of the panels defining a top of the receptacle housing, the receptacle housing mounted to the circuit board at a bottom of the receptacle housing, the panels being conductive to provide EMI shielding for the module cavity;

a gasket assembly provided at the bottom of the receptacle housing, the gasket assembly having a bottom plate, a hinge plate rearward of the bottom plate, and a rear plate extending from a rear of the hinge plate, the bottom plate, the hinge plate and the rear plate being conductive to provide EMI shielding for the module cavity, the bottom plate being coupled to corresponding panels of the receptacle housing at the bottom of the receptacle housing to provide EMI shielding at the bottom of the receptacle housing, the rear plate having an opening receiving the front shroud of the communication connector to provide EMI shielding around the mating interface, the hinge plate is hingedly coupled between the bottom plate and the rear plate to change relative positions of the bottom plate and the rear plate during assembly to the circuit board.

* * * * *